United States Patent [19]

Leiper

[11] Patent Number: 4,480,878

[45] Date of Patent: Nov. 6, 1984

[54] CLEARANCE ADJUSTABLE DRAWER SLIDE ASSEMBLY

[75] Inventor: Fred B. Leiper, Valley Cottage, N.Y.

[73] Assignee: Hardware Designers, Inc., Waterbury, Conn.

[21] Appl. No.: 457,964

[22] Filed: Jan. 14, 1983

[51] Int. Cl.[3] ..... F16C 21/00; A47B 88/00

[52] U.S. Cl. ..... 308/3.8; 308/3.6; 312/330 R; 312/339

[58] Field of Search ..... 308/3.8, 3.6; 312/330, 312/331, 334, 338, 339, 340

[56] References Cited

U.S. PATENT DOCUMENTS

| | | | |
|---|---|---|---|
| 2,889,179 | 6/1959 | Gussack | 308/3.8 |
| 3,298,768 | 1/1967 | Vogt | 312/339 |
| 3,975,063 | 8/1976 | Mahotka et al. | 308/3.8 |
| 4,067,632 | 1/1978 | Sekerich | 308/3.6 X |
| 4,315,661 | 2/1982 | Kessler | 308/3.8 X |

*Primary Examiner*—Stuart S. Levy
*Assistant Examiner*—Thomas R. Hannon
*Attorney, Agent, or Firm*—Mark T. Basseches; Paula T. Basseches

[57] ABSTRACT

The present invention relates to a drawer slide assembly of the type including three telescoping channels including a cabinet mounted channel, a drawer mounted channel, and an intermediate channel coupling the drawer and cabinet channels. The apparatus is characterized in that the position of the drawer relative to the drawer channel may be accurately adjusted without the necessity for demounting the drawer channel from the intermediate channel, thereby greatly shortening the time of installation.

3 Claims, 5 Drawing Figures

CLEARANCE ADJUSTABLE DRAWER SLIDE ASSEMBLY

BACKGROUND OF THE INVENTION

1. Field of the Invention

The present invention relates to a drawer slide assembly and more particularly to a full extension drawer slide assembly of the type used for mounting a drawer to a cabinet for relative translatory movement.

2. The Prior Art

It is conventional to mount a drawer to a cabinet through the use of a drawer slide assembly comprising a first channel adapted to be mounted to a cabinet, a second channel adapted to be mounted to a drawer and an intermediate channel slidably connecting the first and second channels. In the mounted position the channels are in nested or telescoped condition in the closed position of the drawer and in relatively extended position when the drawer is pulled outwardly.

Since drawers are mounted in enclosures which preferably correspond closely in dimension to the front face of the drawer, it is necessary that the attachment, particularly of the drawer to the drawer channel, be effected accurately. If it is not, the face of the drawer will engage against portions of the cabinet above or below the drawer and inhibit the full and smooth movement of the drawer to and from its fully closed position.

In the typical installation of a conventional slide assembly, the cabinet mounted channels are first secured in a predetermined position within the cabinet. The drawer channels are thereafter secured to the drawer in a position which approximates the desired final position.

The initial connection of channel to drawer is made utilizing vertically enlarged slots in the channel which provide a temporary connection. The drawer carrying the temporarily mounted drawer channels is thereafter connected to the remainder of the slide assembly by engaging the drawer channels and the intermediate channels, and the drawer closed. If the connection between drawer channel and drawer leaves the drawer in a position above that desired so that there is inteference between the upper edge of the drawer face and cabinet upon closing of the drawer, it is necessary to remove the drawer by disconnecting the intermediate and drawer mounted channels, lower the drawer relative to the drawer channel, reattach the intermediate and drawer channels and recheck the adjusted position of the parts. If the correction applied is too little or too great, the procedure must be repeated time and again until a precise location of the parts is achieved.

After the correct position is established, a permanent connection between channel and drawer is achieved by affixing fastener means through the drawer channel to the drawer using additional apertures in the channel which do not provide excess clearance between the fastener and the channel.

It will be recognized from the above description that the adjustment of the position of the drawer is a tedious and time-consuming operation, often requiring multiple removals of the drawer, readjustment, repositioning etc.

SUMMARY OF THE INVENTION

The present invention may be summarized as directed to an improved drawer slide assembly characterized in that the drawer and drawer channel may be temporarily interconnected for relative vertical adjustment and, in the fully extended condition of the drawer, access is provided through the intermediate channels to the fastener mechanism securing the drawer to the drawer channel.

In this manner it is possible, without removing the drawer from the cabinet to adjust the connection between the drawer and drawer channel vertically, whereby a precise positioning of the drawer and drawer channels may be achieved without disassembling the channel components.

After the adjusted position is achieved, the drawer and its properly adjusted channels are removed from the cabinet for the application of permanent fastener means.

Thus, in installing a slide assembly in accordance with the invention it is merely necessary approximately to mount the drawer channels to the drawer, effect connection of the channels to the remainder of the slide assembly, adjust the relation between drawer and drawer channels and remove the drawer only once for final affixation.

The invention more particularly includes providing in the intermediate section of a conventional full extension drawer slide assembly, a vertically elongated access aperture which is so coordinated with the spacing of the adjustment slots of the drawer channels that when the drawer is pulled to its fully extended position, the access aperture of the intermediate slide registers with the adjustment aperture of the drawer slide. Since the outer adjustment connection between drawer channel and drawer is normally exposed in the fully extended position of the drawer and since the inner adjustment slot of the channel is accessible through the access aperture of the intermediate channel in the fully extended position, the drawer may be accurately located relative to the drawer channel without disassembly of the parts.

It is accordingly an object of the invention to provide a drawer slide assembly of the full extension type wherein accurate adjustment of the drawer relative to the cabinet may be achieved without disassembling the drawer channel components.

It is a further object of the invention to provide a device of the type described which includes a cabinet channel, a drawer channel and an intermediate channel slidably interposed therebetween, which device, in the fully extended position of the drawer, provides access to the fastener mechanisms which temporarily support the drawer.

To attain these objects and such further objects as may appear herein or be hereinafter pointed out, reference is made to the accompanying drawings, forming a part hereof in which.

Figure 5:
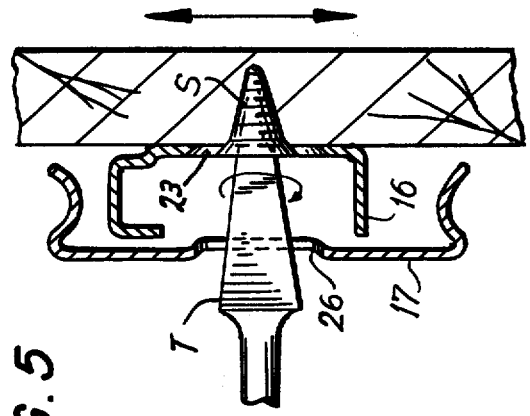
FIG. 5 is a magnified vertical section taken on the line 5—5 of FIG. 3.
Figure 1:
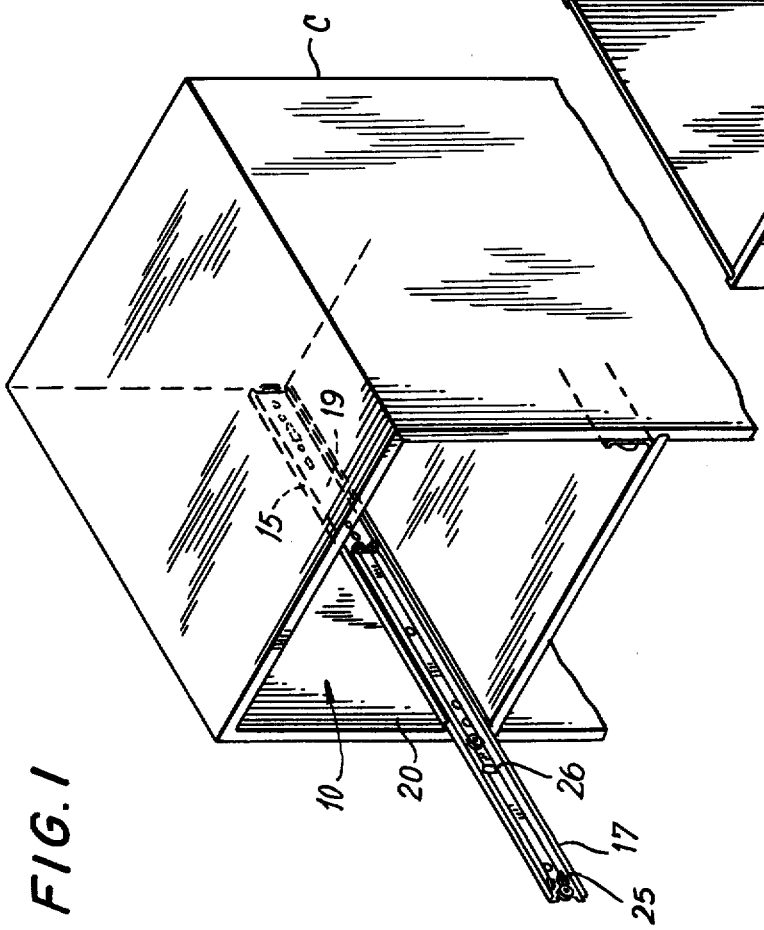
FIG. 1 is a fragmentary perspective view of a cabinet to which a drawer slide assembly in accordance with the invention has been connected, the view showing the cabinet channel and intermediate channel in a relatively extended position.

Referring now to the drawings, there is shown in FIG. 1 a fragmentary portion of a cabinet C having an opening 10 within which is to be mounted a drawer 11 including side walls 12, 13, and a drawer face 14. Desirably, the drawer face 14, in the closed position of the drawer, forms a close fit at all of its borders with the opening 10.

Each of the two drawer slides of the present invention comprises three generally U-shaped channel members having parallel webs, namely a first or cabinet mounted channel member 15, a second or drawer mounted channel member 16 and an intermediate channel member 17. It will be understood that ball bearings, roller or other anti-friction means, exemplified in the illustrated embodiment by the roller members 18, are interposed between the intermediate channel 17 and each of the cabinet and drawer mounted channels 15, 16, respectively, whereby the channel sections are permitted to be smoothly shifted between the fully extended position shown in FIG. 3 and the fully closed position, whereat the three channel sections are internested and the drawer face 14 is disposed within the opening 10 of the cabinet.

Since the channel assembly is in all respects conventional insofar as concerns the specific anti-friction means employed and since the invention hereof is in no wise related to or limited to the use of a specific anti-friction mechanism, further description thereof is not deemed necessary.

The mounting of the cabinet channel 15 to the cabinet is conventionally effected and involves running a plurality of fasteners, for instance wood screws, outwardly through the central web portion 19 of the channel and into the side wall 20 of the cabinet.

It will be understood that the drawer slide assemblies are identical to opposite sides of the drawer (except in some instances for handling) and accordingly a description of one such assembly will suffice.

After the cabinet channels 15 are secured, the drawer channels 16 are affixed to the outer side walls 12, 13 of the drawer in a predetermined and approximately spaced relation from the bottom edges 21 of the side walls.

Figure 2:
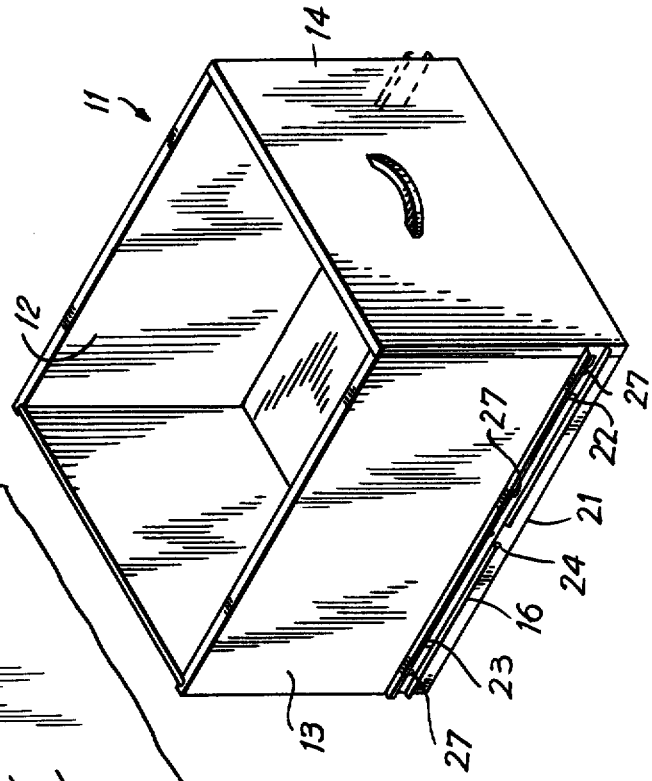
FIG. 2 is a perspective view of a drawer adapted to be mounted in the cabinet of FIG. 1, with the drawer channel secured thereto.
Figure 3:
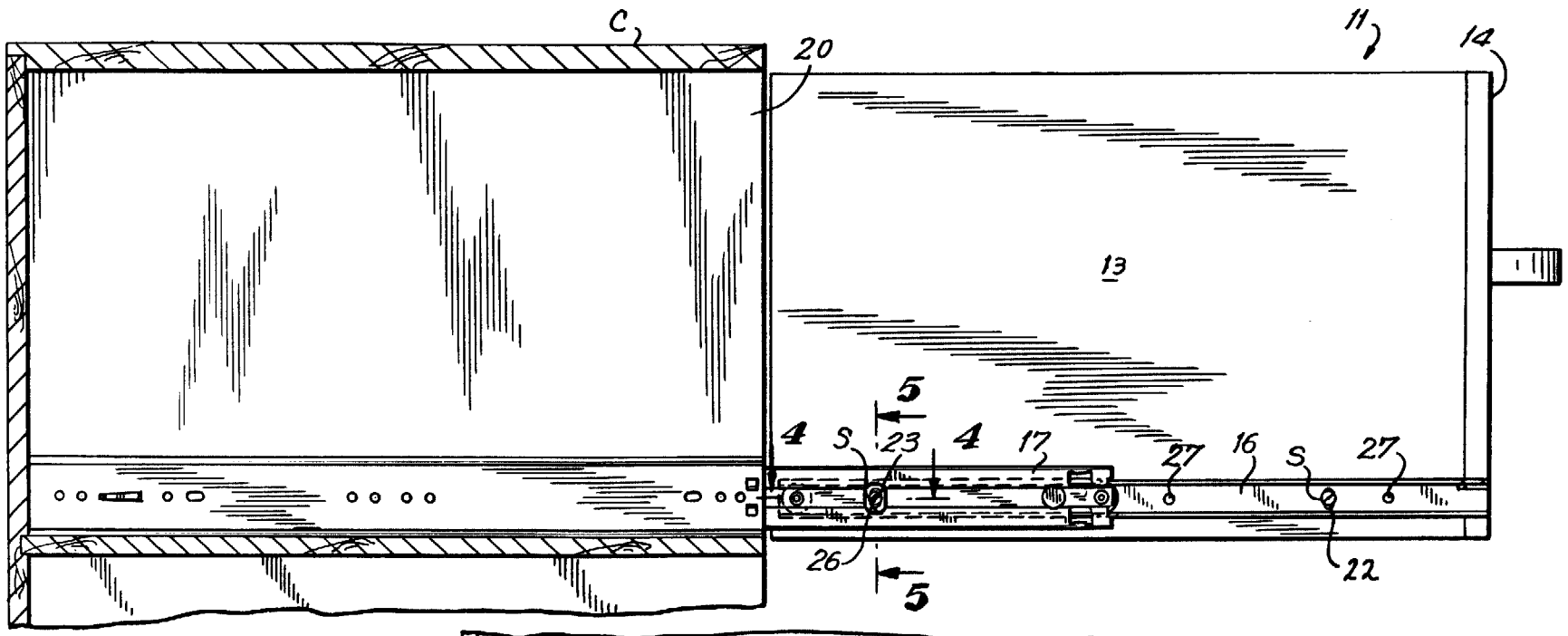
FIG. 3 is a side elevational view of the cabinet drawer and channel assemblies in the fully extended condition of the parts.
Figure 4:
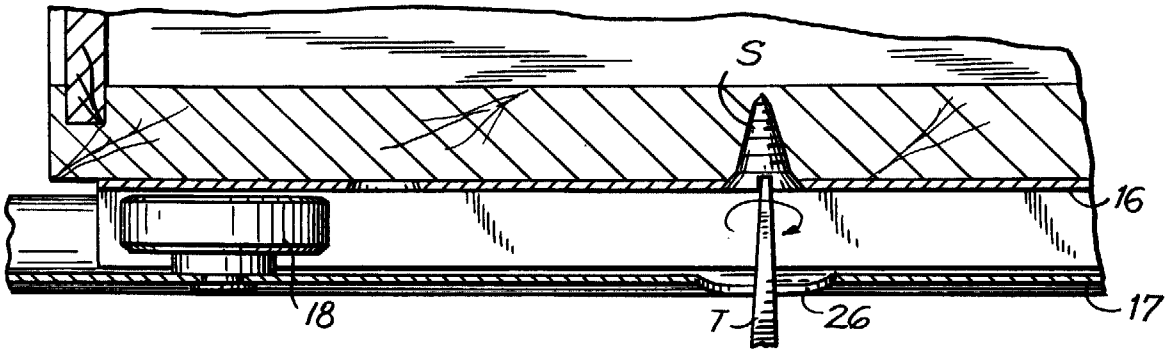
FIG. 4 is a magnified horizontal section taken on the line 4—4 of FIG. 3, illustrating adjustment of a temporary fastener connecting the drawer and drawer channel.

As will be best observed from an inspection of FIGS. 2 and 3, the temporary affixation utilizing wood screws S passing through vertically elongated adjustment slots 22, 23 will hold the drawer in a predetermined fixed orientation relative to the channel 16 when the screws S are tightened but will permit a relative vertical shifting movement between the noted components when the screws are relaxed.

After the channels 16 are temporarily mounted to the drawer slides 12, 13 and with the intermediate channel 17 in the extended position shown in FIG. 1, the drawer channels 16 are mounted over the intermediate channels and the drawer closed.

As the drawer is closed, it will be immediately apparent to the installer, as a result of the interfit of the drawer face 14 and opening 10, whether the drawer is too high, too low or accurately aligned relative to channel 16.

Assuming that a misalignment is encountered, the drawer is pulled outwardly to the fully extended position shown in FIG. 3. The fully extended position is established by virtue of the blocking tab 24 of channel 16 engaging against padded stop member 25 adjacent the outer end of intermediate channel 17.

To enable fine adjustment of the drawer without removal thereof from the cabinet, the intermediate channels 17 are provided with vertical elongated access slots 26. The spacing of the access slots 26 from the blocking member 25 is such that when the stop member 24 of the channel 16 is engaged against the blocking member 25, the access slot 26 is aligned with the inner adjustment slot 23 of channel slide 16. This position of the parts is depicted in FIG. 3.

From such figure it will be readily recognized that the installer may, by passing a screw driver or like tool T through the access aperture 26, loosen and retighten the adjustment screw S.

It will likewise be apparent from FIG. 3 that the screw S extending through adjustment aperture 22 adjacent the front face of the drawer will be directly exposed.

By appropriate tightening and retightening, with intervening shifting of the drawer relative to the slides 16, the installer may achieve an accurate location of the drawer and channels 16, whereby a precise interfitted adjustment between the drawer face and the opening 10 may be derived without demounting the drawer.

At this point, i.e. with the drawer secured to the channels 16 solely by screws S extending through adjustment slots 22 and 23, the drawer may be removed and permanent fastening of the channel to the drawer effected by passing additional screws or like fasteners through the permanent mounting apertures 27 formed in the channel 16.

From the foregoing description it will be readily recognized that after the drawer member has been temporarily secured to the channels 16 and the channels 16 connected to the intermediate channels 17, final adjustment of the components may be completed without requiring removal of the drawer from the cabinet. It is only after a desired adjusted position has been achieved that the drawer need be removed for installation of the permanent mounting screws through apertures 27.

By the expedient of forming an access aperture in the intermediate channel 17, which access aperture aligns with the adjustment slot 23 of the channel members 16, the time required for installation of a drawer is materially reduced.

It is important to note that the position of the access aperture to the intermediate channel is preferably coordinated to register with the adjustment aperture of the drawer channel in the fully extended position of the channel components, whereby the registering position is achieved responsive to full opening of the drawer.

As will be apparent to those skilled in the art, numerous variations in details of construction may be made without departing from the spirit of the invention. Accordingly, the invention is to be broadly construed within the scope of the appended claims.

Having thus described the invention and illustrated its use, what is claimed as new and is desired to be secured by Letters Patent is:

1. A drawer slide assembly comprising a first channel adapted to be mounted to a cabinet, a second channel adapted to be mounted to a drawer, and an intermediate channel nested with and slidably connected to said first and second channels for axial translatory relative movement with respect to each of said first and second channels, said channels including parallel web portions, said channels being shiftable between a closed position whereat said channels are in registered overlapping position to an extended position whereat said intermediate channel projects from said first channel and said second channel projects from said intermediate channel, stop means interposed between said intermediate channel and said first and second channels, respectively, for blocking axial movement of said channels beyond a predetermined fully extended position, a first series of mounting apertures through the web portion of said second channel, the apertures of said first series being mutually offset lengthwisely along said channel, at least two vertically elongate adjustment apertures formed in said web of said second channel in mutually spaced relation, at least one of said adjustment apertures being located adjacent an inner end portion of said channel, and an access aperture formed in said web of said intermediate channel, said access aperture being positioned to register with said one of said adjustment apertures only in said fully extended position of said channels.

2. A drawer slide assembly in accordance with claim 1 wherein an additional said adjustment aperture extends outwardly of the outermost end of said intermediate channel in said fully extended position of said channels.

3. A drawer slide assembly in accordance with claim 2 wherein said access aperture is of larger dimension than said adjustment aperture, whereby an adjustment tool may be inserted through said access aperture and into proximate relation to substantially the entirety of said adjustment aperture.

* * * * *